US008159159B2

(12) United States Patent
Fernandez et al.

(10) Patent No.: US 8,159,159 B2
(45) Date of Patent: Apr. 17, 2012

(54) CONTROLLING TENSION IN ROLL-BASED PRINT MEDIA

(75) Inventors: David Chanclon Fernandez, Barcelona (ES); Eduardo Martin, Sabadell (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 862 days.

(21) Appl. No.: 12/240,150

(22) Filed: Sep. 29, 2008

(65) Prior Publication Data

US 2009/0136281 A1 May 28, 2009

Related U.S. Application Data

(60) Provisional application No. 60/990,437, filed on Nov. 27, 2007.

(51) Int. Cl.
*B65H 77/00* (2006.01)

(52) U.S. Cl. ..... 318/6; 318/430; 318/432

(58) Field of Classification Search ..... 318/6, 430, 318/432, 434; 702/33, 188, 187; 347/5, 347/14, 16, 37; 358/413
See application file for complete search history.

(56) References Cited

U.S. PATENT DOCUMENTS

| | | | | |
|---|---|---|---|---|
| 6,082,914 | A | 7/2000 | Barrus | |
| 6,338,029 | B1 * | 1/2002 | Abbata et al. | 702/183 |
| 6,454,197 | B1 | 9/2002 | Everett | |
| 7,097,264 | B2 * | 8/2006 | Saito et al. | 347/5 |
| 7,157,873 | B2 * | 1/2007 | Carolan | 318/432 |
| 7,481,506 | B2 * | 1/2009 | Saito et al. | 347/5 |
| 7,835,887 | B2 * | 11/2010 | Abbata et al. | 702/188 |
| 7,878,723 | B2 * | 2/2011 | Igarashi et al. | 400/582 |
| 2004/0041854 | A1 * | 3/2004 | Saito et al. | 347/5 |
| 2004/0164691 | A1 * | 8/2004 | Andoh et al. | 318/268 |
| 2005/0099153 | A1 * | 5/2005 | Komatsu et al. | 318/807 |
| 2006/0214965 | A1 * | 9/2006 | Saito et al. | 347/14 |
| 2006/0244404 | A1 * | 11/2006 | Carolan | 318/432 |
| 2007/0059078 | A1 | 3/2007 | Silverbrook | |
| 2008/0056798 | A1 * | 3/2008 | Igarashi et al. | 400/582 |
| 2009/0016797 | A1 * | 1/2009 | Brugue et al. | 400/613 |
| 2009/0281734 | A1 * | 11/2009 | Abbata et al. | 702/33 |

FOREIGN PATENT DOCUMENTS

JP 2006-137607 6/2006

* cited by examiner

*Primary Examiner* — Paul Ip

(57) ABSTRACT

An apparatus, method and computer program for controlling the tension in roll-based print media. The apparatus comprises: a motor arranged to apply torque to the roll of print media to create tension in the print media; and processing means arranged to detect first and second electrical drive parameters applied to the motor when the print media is displaced at a substantially constant velocity with a substantially zero tension and a predetermined tension created therein, respectively, and to determine a print media tension value based on a difference between the first and second detected electrical drive parameters.

17 Claims, 4 Drawing Sheets

CONTROLLING TENSION IN ROLL-BASED PRINT MEDIA

CROSS REFERENCE TO RELATED APPLICATIONS

This application claims the benefit of provisional patent application Ser. No. 60/990,437, filed Nov. 27, 2007, titled "CONTROLLING TENSION IN ROLL-BASED PRINT MEDIA" which application is incorporated by reference herein as if reproduced in full below.

FIELD OF THE INVENTION

This invention relates to field of printing with roll-based print media, and more particularly to controlling tension in roll-based print media.

BACKGROUND

Printers such as inkjet printers which print onto a variety of print media such as paper or film are well known. As well as accepting print media in a single sheet format, some printers also accept print media fed from a supply roll of print media. Such a printer may be typically referred to as a roll-based printer, being a printer that accepts roll-based print media.

It will be appreciated that, in order to achieve consistent print quality, it is important that feeding of the print media is finely controlled. Variation in print media speed or tension may result in deterioration of print quality in the form of, for example, a distorted image.

Accurate control of print media feeding from a roll is particularly problematic in wide-format printing (otherwise known as large format printing), where the width of the print media is large, for example 32 cm to 150 cm (or even more).

The feeding of print media from a roll for a large format printer is typically undertaken by means of a roller that advances the print media with a traction provided by pinch wheels. The print media is pulled from a roll that has a mechanism to provide some tension (back-tension) to the media. A conventional approach to providing such tension is to use friction to produce a resistance to the rotation of the roll.

Controlling the tension in the print media is of high importance. If the tension is too high the print media can slip from the traction of the roller, and even a small slippage can produce undesirable printing artifacts and reduce print quality. Conversely, if the tension is too low, the print media may not be properly guided and/or controlled and the position of the media may deviate laterally. Further, wrinkles in the print media may be created due to a mismatch in traction at different parts of the roller.

Some roll-based printers also retrieve the print media in a roll after printing, by extracting the print media from the printer and collecting it on a spindle. For the same reasons as feeding of print media to a printer, controlling the media tension is also important in the case of retrieving print media from a printer.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

According to an embodiment of the invention, there is provided a method of calibrating apparatus for controlling the tension in roll-based print media, wherein the apparatus comprises a motor arranged to apply torque to the roll of print media to create tension in the print media, and wherein the method comprises the steps of:

detecting a first electrical drive parameter applied to the motor when the print media is displaced at a substantially constant velocity with substantially zero tension created therein;

detecting a second electrical drive parameter applied to the motor when the print media is displaced at the same substantially constant velocity with a predetermined tension created therein; and determining a print media tension value based on a difference between the first and second detected electrical drive parameters.

The step of determining a print media tension value may comprise multiplying the difference between the first and second detected electrical drive parameters by a predetermined constant value.

By employing a method according to an embodiment, a printer is able to automatically calibrate the back-tension in the print media using a media advance motor as a form of measuring device.

Thus, there is provided an apparatus for controlling the tension in roll-based print media, and a method for calibrating the same, which can maintain substantially optimal tension in the print media. In other words, the invention enables the back-tension to be maintained within a preferred range.

Such an optimal back-tension may be bigger if the media width is bigger. In particular embodiments, the optimal back-tension may linearly increase with the media width. Such a mechanism and method may therefore be used to provide an optimal tension in print media fed to and/or from a large format printer.

Figure 1:
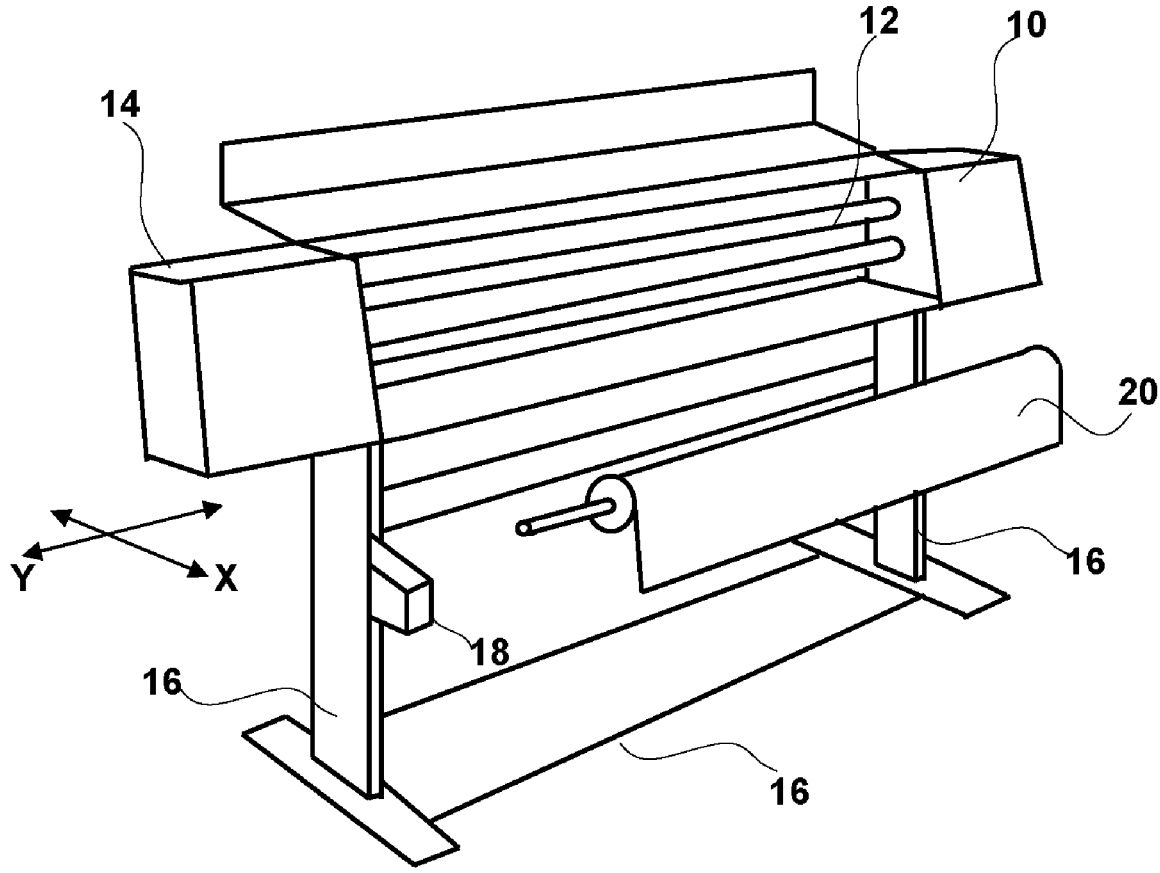
FIG. 1 is an illustration of a printer according to an embodiment of the invention.

Referring to FIG. 1, a large format printer according to an embodiment comprises a printing unit 10 having a print head (not visible) which is adapted to reciprocate along a scan axis assembly 12 within a housing 14. The printing unit 10 is supported on a framework 16 so that it is raised up from a floor or surface upon which the framework 16 is positioned. The framework 16 comprises a supporting assembly 18 for rotatably supporting a supply roll of print media 20 such that print media may be fed from the supply roll 20 to the printing unit 10.

The print media 20 is fed along a media axis denoted as the X axis. A second axis, perpendicular to the X axis, is denoted as the Y axis. The print head reciprocates along a scan axis over print media 20 fed to the printer along, wherein the scan axis is parallel to the Y axis.

The supporting assembly 18 further comprises apparatus (not visible) for controlling the tension in the roll-based print media 20 according to an embodiment of the invention. The apparatus cooperates with the supply roll to control the tension in the print media 20 fed from the supply roll. In this example, a motor is coupled to the supply roll 20 via a gear train. Back-tension is provided by the motor applying a torque to the supply roll 20, wherein a controller controls the torque applied by the motor based on the radius of the roll of print media.

Figure 2:
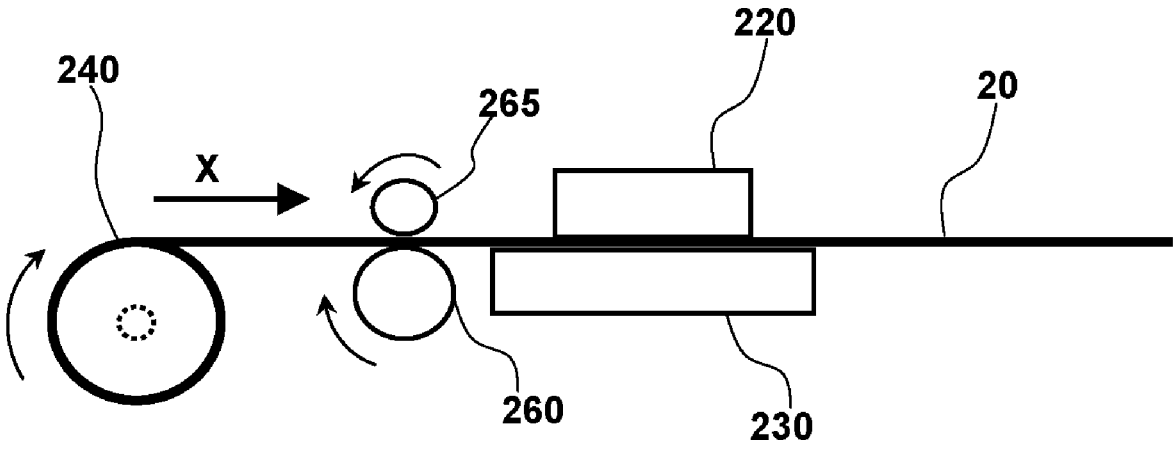
FIG. 2 is a schematic section of a printer according to an embodiment of the invention.

FIG. 2 schematically represents the print media 20 being fed to a printer between a printhead 220 and a platen 230. The print media 20 is extracted from a supply roll 240 and advances onto the platen 230. The direction of media advance is in the X direction or X axis. As the print media 20 passes between the printhead 220 and the platen 230, the printhead 220 reciprocates or scans along the media 20 along the Y direction or Y axis (which is in this case perpendicular to the X axis). More specifically, a drive roller 260 (driven/rotated by a drive motor) and pinch roller 265 arrangement is used to extract the print media from the supply roll 240. Here, the print media 20 is advanced due to friction/traction provided by the rotating drive roller 260 and pinch roller 265. Further, a gear train (not shown) is arranged to be driven by the motor to apply the torque to the roll of print media.

Based on the electrical drive parameter supplied to the drive motor during movement of the print media, the apparatus can be calibrated and the back-tension in print media controlled. In this way, the drive motor is used as a form of measurement device to enable the back tension in the print media to be calculated and subsequently controlled.

It is noted that by displacing the print media at a constant velocity and detecting the average voltage applied (or Pulse Width Modulation (PWM)), the torque applied by the drive motor can be determined. Pulse Width Modulation refers to a method of controlling a motor by applying pulses of voltage. Although a constant voltage is not exactly the same as a train of pulses, they can be considered to be equivalent for practical applications of the invention. For this reason, voltage and PWM may be considered to be the same in the context of this description. It will be understood that the torque applied by the drive motor may also be determined by detecting the applied current.

For accurate calibration and control of the tension in the print media, factors influencing the torque applied by the drive motor should preferably be accounted for. One such factor is that the voltage applied to the drive motor depends not only on the torque but also on the speed. A further factor is that frictional forces, other than that caused by back-tension in the media, also affect the torque applied by the drive motor.

Figure 3:
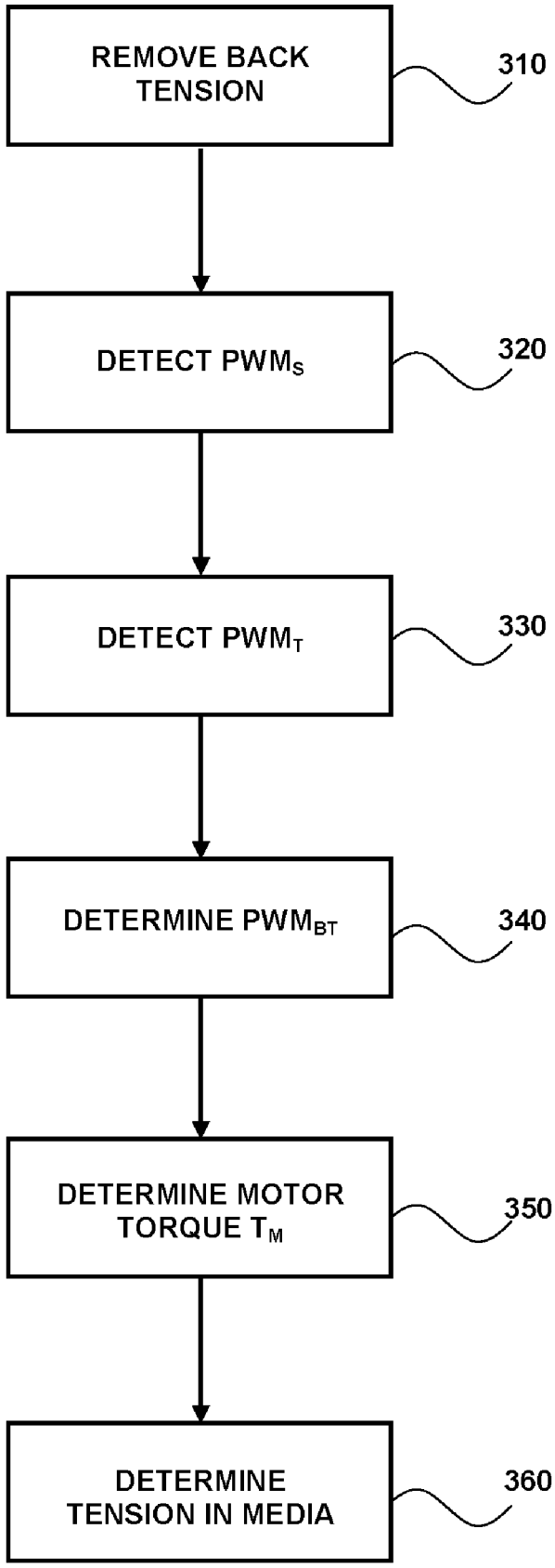
FIG. 3 is a flow diagram of a method according to an embodiment of the invention.

A method of calibrating apparatus for controlling the tension in roll-based print media will now be described with reference to FIGS. 2 and 3. The method 300 accounts for the aforementioned factors which influence the torque applied by the drive motor.

First, in step 310, back-tension in the media is removed so that substantially zero tension is created in the print media. By way of example, this may be done by extracting the print media 20 from the supply roll 240 (i.e. advancing the media in the X direction) and then reversing the direction of the drive motor to move the print media 20 back in the opposite direction (i.e. back towards the supply roll 240), thereby generating a "bubble" or wrinkle of excess print media 20.

In the step 320, the print media 20 is advanced in the X direction at a substantially constant velocity $V_M$ with substantially zero tension created therein. In other words, the print media is advanced or fed to the printer so that the wrinkle of excess print media is reduced or 'taken up'. As the print media 20 is advanced with zero tension created therein, a first voltage $PWM_S$ applied to the drive motor is detected. This first voltage $PWM_S$ can be used for calculating the motor torque when back tension is not present in the media, and represents the motor voltage due factors other than the back tension in the print media.

Once the print media 20 has been advanced so the there is no excess print media and a non-zero value of tension is present in the print media 20, a second voltage $PWM_T$ applied to the drive motor is detected, in step 330, as the print media 20 is displaced or advanced at the same substantially constant velocity $V_M$ with a predetermined non-zero tension created therein. The second voltage $PWM_T$ can be used to represent the total motor voltage including all factors which influence the torque applied by the drive motor.

It will be understood that a voltage $PWM_{BT}$ associated with only the back tension can be obtained based on the difference between the first $PWM_S$ and second $PWM_T$ detected voltages, i.e. the total motor voltage minus the motor voltage associated with factors other than the back tension in the print media. Therefore, in step 340, a third voltage $PWM_{BT}$ representing the motor voltage due to back tension in the print media 20 is determined based on a difference between the first $PWM_S$ and second $PWM_T$ detected voltages.

In step 350, the torque in the drive motor is then calculated based on the third voltage $PWM_{BT}$. More specifically, a value of torque $T_M$ in the drive motor is calculated according to equation 1, $$T_M = \frac{K \cdot PWM_{BT}}{R} \tag{1}$$

wherein, $T_M$ is the motor torque, K is the motor torque constant, R is the motor resistance, and $PWM_{BT}$ is the PWM voltage increase due to back tension in the print media.

In step 360, a value of tension in the print media (i.e. the back tension) is calculated based on the value of motor torque $T_M$ obtained in step 350. More specifically, a value of back tension BT in the print media is calculated according to equation 2, $$BT = \frac{T_M \cdot i \cdot \eta}{r} \tag{2}$$

wherein, $T_M$ is the motor torque, i is the transmission ratio of the motor to drive roller 260 arrangement, η is the transmission efficiency (i.e. a measure of the efficiency of the motor to drive roller 260 transmission arrangement), and r is the radius of the drive roller 260.

It will be appreciated that equation 1 may be substituted in to equation 2, thereby resulting in equation 3, $$BT = \frac{T_M \cdot i \cdot \eta \cdot K}{R \cdot r} PWM_{BT}. \tag{3}$$

From equation 3, it will be understood that a value of back tension BT in the print media can be calculated according to equation 4, by multiplying the determined voltage increase due to back tension $PWM_{BT}$ by a constant α, wherein α is represented by equation 5, $$BT = \alpha \cdot PWM_{BT}, \tag{4}$$

$$\alpha = \frac{T_M \cdot i \cdot \eta \cdot K}{R \cdot r}. \tag{5}$$

Steps 340, 350 and 360 may therefore be combined and summarised as the step of determining a print media tension value BT based on a difference between the first $PWM_S$ and second $PWM_T$ detected voltages, wherein determining a print media tension value BT comprises multiplying the difference between the first and second detected voltages by a predetermined constant α. From equation 5, it can be seen that the predetermined constant value α is dependent upon a value of motor resistance and a value of motor torque.

Upon obtaining a value of the print media tension BT, the drive motor can be calibrated and controlled according to the difference between the current print media back tension and a desired value for the print media back tension. In other words, the torque applied to the roll of print media may be controlled based upon the determined print media tension value BT.

For a better understanding, a detailed algorithm for back tension calibrations using a drive roller motor servo will now be detailed.

Parameters

OVDDIST: Distance necessary to advance the front edge of paper from pinch wheel to the start calibration position (overdrive engaged)

CALIBDIST: Distance to advance for the calibration movements

GENERALSPEED: Speed for the non-calibration movements

CALIBSPEED: Speed for the calibration movements

RUBISHINT: Number of interruptions that must not be taken in account in the PWM average calculation during slew KDRIVE: Relation between media drive PWM and Back Tension Outputs PWMSINGLESHEET: Media Drive Motor PWM average during slew without back tension PWMBOND: Media Drive Motor PWM average during slew with Bond Back Tension PWMGLOSSY: Media Drive Motor PWM average during slew with Glossy Back Tension BACKTENSIONBOND: The Back Tension force (N) calculated with the Bond settings using the default Tension constants BACKTENSIONGLOSSY: The Back Tension force (N) calculated with the Glossy settings using the default Tension constants Step 0: Set Default Constants A) Set the Tension constants to their default value (reset previous calibrations if any)

Step 1: Calibrate Roll Without Back Tension (As It Was Single Sheet)

A) Move paper forward to ensure there is overdrive tension (distance to advance OVDDIST, GENERALSPEED)

B) Disable the tension

C) Remove back tension to make movements simulating single sheet (move forward and backwards distance CALIBDIST, GENERALSPEED)

D) Make a movement forward without back tension and calculate the average PWM during slew (output=PWMSINGLESHEET)

The first RUBISHINT interruptions in SLEW must not be used for the average PWM calculation to avoid transitory effects The distance to advance is CALIBDIST The speed for the advance is CALIBSPEED E) Enable the tension F) Make a movement backwards to move the paper back to continue the calibration. The distance to move backwards is (CALIBDIST+OVDDIST, GENERALSPEED)

Step 2: Calibrate Roll with Bond Back Tension

A) Set the bond back tension level for the rewinder

B) Move forward (OVDDIST, GENERAL SPEED).—The radius should get calibrated

C) Make a movement forward and calculate the average PWM during slew (output=PWM BOND)

a. The first RUBISHINT interruptions in SLEW must not be used for the average PWM calculation to avoid transitory effects b. The distance to advance is CALIBDIST c. The speed for the advance is CALIBSPEED D) Make a movement backwards to move the paper back to continue the calibration. The distance to move backwards is (CALIBDIST+OVDDIST, GENERALSPEED)

Step 3: Calibrate Roll with Glossy Back Tension

A) Set the glossy back tension level for the rewinder

B) Move forward (OVDDIST, GENERAL SPEED).—The radius should get calibrated

C) Make a movement forward and calculate the average PWM during slew (output=PWMGLOSSY)

1. The first RUBISHINT interruptions in SLEW must not be used for the average PWM calculation to avoid transitory effects 2. The distance to advance is CALIBDIST 3. The speed for the advance is CALIBSPEED D) Make a movement backwards to move the paper back to continue the calibration. The distance to move backwards is (CALIBDIST+OVDDIST, GENERALSPEED)

Step 4: Back Tension Calculation Using Media Drive Data

A) Calculate the BackTension (N) for the bond settings. The output of the calculation is:

BACKTENSIONBOND=(PWMBOND−PWMSINGLESHEET)*KDRIVE

B) Calculate the BackTension (N) for the glossy settings. The output of the calculation is:

BACKTENSIONGLOSSY=(PWMGLOSSY−PWMSINGLESHEET)*KDRIVE

Step 5: Set New Rewinder Constants

Using the calculated BACKTENSIONGLOSSY and BACKTENSIONBOND, correct the deviation between the measured back tension and the desired back tension:

BACKTENSIONBONDCORRECTION=BACKTENSIONBOND−BACKTENSIONBONDDESIRED (6)

BACKTENSIONGLOSSYCORRECTION=BACKTENSIONGLOSSY−BACKTENSIONGLOSSYDESIRED (7).

It is noted that embodiments may be arranged such that the motor is able to apply sufficient torque to actually rewind the print media onto the supply roll. Such embodiments may therefore be used to help a user in the process of loading and/or unloading print media to a printer.

So far embodiments have been described which are arranged to calibrate and control the tension in print media fed from a roll of print media to a printer. It should, however, be understood that alternative embodiments may also be arranged to calibrate and control the tension in roll-based media fed from a printer to a roll of print media (i.e. print media extracted from a printer and collected on a spindle).

Figure 4:
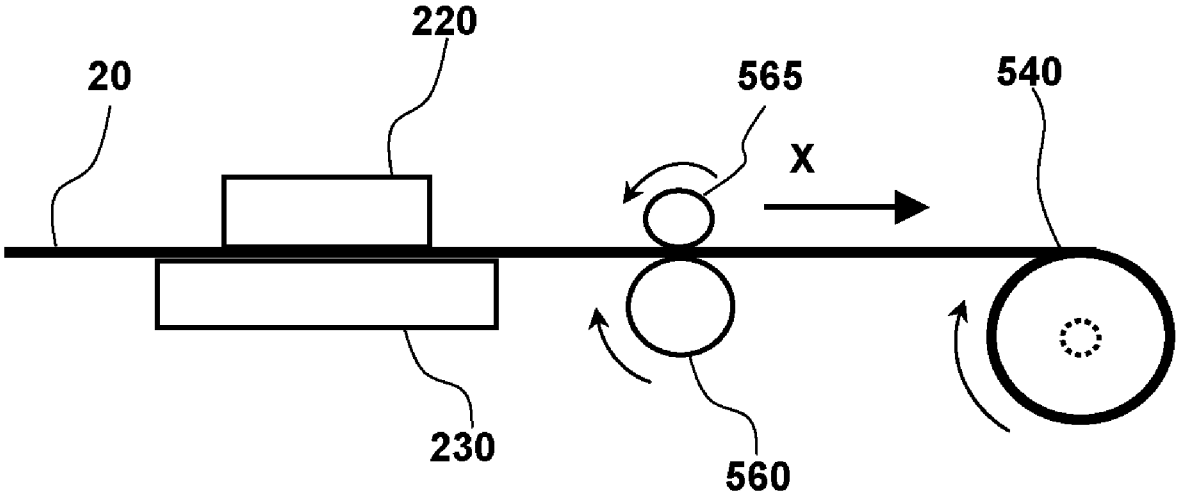
FIG. 4 is a schematic section of a printer according to an alternative embodiment of the invention.

By way of example, FIG. 4 schematically represents the print media 20 being fed between a printhead 220 and a platen 230 of a printer to a roll 540 of print media 20 mounted on a spindle. The print media 20 is extracted from the printer and the direction of media advance is in the X direction or X axis. More specifically, a drive roller 560 and pinch roller 565 arrangement is used to extract the printer. Here, the print media 20 is advanced due to friction/traction provided by the rotating drive roller 560 and pinch roller 565.

Based on the voltage supplied to the drive motor during movement of the print media, the apparatus can be calibrated and the back-tension in print media controlled according to the invention (i.e. as described above with reference to FIG. 3).

Embodiments provide numerous advantages when compared to conventional media feeding concepts. Some if of these advantages may be summarized as follows.

Feeding and extraction of print media to and from a printer can be better controlled by maintaining an optimal amount of tension, thereby reducing variability in back tension. This may allows for higher variability in hardware components by avoiding screenings and the cost increases due to screenings and part rejections.

Undesirably excessive values of tension in the print media can be avoided, thereby preventing image quality degradations (such as banding) caused by the print media suddenly slipping on the spindle.

Further, adversely low values of tension in the print media can also be circumvented so the print media does not wrinkle and/or skew (i.e. deviate from a desired orientation).

Embodiments provide a high degree of operating flexibility because the tension can be controlled to deal with media specific issues. For example, the arrangement may be set up to maintain low tension in slippery print media, or to maintain higher tension in rigid media prone to jamming. Embodiments may also compensate back tension for life degradation of the product.

Alternative embodiments may be used for rewinding the print media back onto the supply roll, which avoids a manual user operation and can be used to ensure that there is not a step in tension when a "bubble" or wrinkle of excess print media is eliminated and the media gets taught (this kind of step in the tension produces a specific printing artifact known as one-time banding).

Embodiments can be used a measurement tool, independent of whether or not calibration is performed, thereby enabling system integrity checks.

While specific embodiments have been described herein for purposes of illustration, various modifications will be apparent to a person skilled in the art and may be made without departing from the scope of the invention.

The invention claimed is:

1. A method of calibrating apparatus for controlling the tension in roll-based print media, wherein the apparatus comprises a motor arranged to apply torque to the roll of print media to create tension in the print media, and wherein the method comprises the steps of:

detecting a first electrical drive parameter applied to the motor when the print media is displaced at a substantially constant velocity with substantially zero tension created therein;

detecting a second electrical drive parameter applied to the motor when the print media is displaced at the same substantially constant velocity with a predetermined tension created therein; and determining a print media tension value based on a difference between the first and second detected electrical drive parameters and a characteristic of said roll-based media.

2. A method according to claim 1, wherein the step of determining a print media tension value comprises determining the print media tension value by multiplying the difference between the first and second detected electrical drive parameters by a predetermined constant value ($\alpha$).

3. A method according to claim 2, wherein the predetermined constant value ($\alpha$) is dependent upon a value of motor resistance and a value of motor torque.

4. A method according to claim 2, wherein the apparatus further comprises: a print media roller adapted to displace the print media; and a gear train arranged to be driven by the motor to apply the torque to the roll of print media, and wherein the predetermined constant value ($\alpha$) is dependent upon the transmission ratio of the gear train, the transmission efficiency of the gear train, and the radius of the print media roller.

5. A method according to claim 1, wherein the apparatus is arranged to control the tension in roll-based print media fed from a roll to a printer.

6. A method according to claim 1, wherein the apparatus is arranged to control the tension in roll-based print media fed from a printer to a roll.

7. A method according to claim 1, further comprising the step of controlling the torque applied to the roll of print media based upon the determined print media tension value.

8. Apparatus for controlling the tension in roll-based print media comprising a motor arranged to apply torque to the roll of print media to create tension in the print media, processing means arranged to detect first and second electrical drive parameters applied to the motor when the print media is displaced at a substantially constant velocity with a substantially zero tension and a predetermined tension created therein, respectively, and to determine a print media tension value based on a difference between the first and second detected electrical drive parameters and a characteristic of said roll-based print media.

9. The apparatus of claim 8, wherein the processing means is adapted to determine the print media tension value by multiplying the difference between the first and second detected electrical drive parameters by a predetermined constant value ($\alpha$).

10. The apparatus of claim 9, wherein the predetermined constant value ($\alpha$) is dependent upon a value of motor resistance and a value of motor torque.

11. The apparatus of claim 8 further comprising: a print media roller adapted to displace the print media; and a gear train arranged to be driven by the motor to apply the torque to the roll of print media, and wherein the predetermined constant value ($\alpha$) is dependent upon the transmission ratio of the gear train, the transmission efficiency of the gear train, and the radius of the print media roller.

12. The apparatus of claim 8, wherein the apparatus is arranged to control the tension in roll-based print media fed from a roll to a printer.

13. The apparatus of claim 8, wherein the apparatus is arranged to control the tension in roll-based print media fed from a printer to a roll.

14. The apparatus of claim 8, further comprising a controller arranged to control the torque applied to the roll of print media based upon the determined print media tension value.

15. A printer comprising the apparatus of claim 8, wherein the printer is arranged to receive print media fed to it from the apparatus r to feed print media to the apparatus.

16. The printer of claim 15, wherein the printer is arranged to removably receive a spindle having roll-based print media loaded thereon, and wherein the spindle has a gear arranged to be driven by the motor.

17. A computer program comprising computer program code means adapted to perform, when run on a computer, the steps of:

detecting a first electrical drive parameter applied to a motor when a print media is displaced at a substantially constant velocity with substantially zero tension created therein;

detecting a second electrical drive parameter applied to the motor when the print media is displaced at the same substantially constant velocity with a predetermined tension created therein; and determining a print media tension value based on a difference between the first and second detected electrical drive parameters and a characteristic of said print media.

* * * * *